United States Patent [19]

DeBoynton

[11] 4,366,790

[45] Jan. 4, 1983

[54] CARBURETOR BY-PASS AND FUEL CONTROL SYSTEM

[76] Inventor: William L. DeBoynton, 520 E. Norman Ave., Arcadia, Calif. 91006

[21] Appl. No.: 171,246

[22] Filed: Jul. 22, 1980

[51] Int. Cl.[3] ..... F02D 31/00

[52] U.S. Cl. ..... 123/325; 123/587; 123/198 DB; 261/DIG. 19

[58] Field of Search ..... 123/198 DB, 320, 325, 123/327, 336, 587, DIG. 11, 324, 339, 399, 402, 403; 261/DIG. 19

[56] References Cited

U.S. PATENT DOCUMENTS

| | | | |
|---|---|---|---|
| 3,371,914 | 3/1968 | Walker | 123/327 X |
| 3,795,237 | 3/1974 | Denton | 123/DIG. 11 |
| 3,982,507 | 9/1976 | Asaka et al. | 123/327 X |
| 4,106,471 | 8/1978 | Nakajima et al. | 123/324 X |
| 4,194,477 | 3/1980 | Sugiyama | 123/327 |

*Primary Examiner*—William A. Cuchlinski, Jr.
*Attorney, Agent, or Firm*—Linval B. Castle

[57] ABSTRACT

A fuel-saving and emission reduction system for internal combustion engines includes electronic carburetor controlling circuitry and a carburetor by-pass system which stops fuel flow to the engine when power from combustion is not required. A normally open by-pass control butterfly valve in the fuel/air passage between the throttle valve and the engine intake manifold is operated by a motor, such as a solenoid or the like, under control of the controlling circuitry and is closed only upon release of the engine throttle and during the period that the vehicle has sufficient speed to assure restart upon reapplication of the fuel/air flow. A carburetor by-pass valve is held in a normally closed position by the combined effects of spring bias and the normal vacuum in the fuel/air passage. When the normally open by-pass control butterfly is closed, the fuel/air vacuum is reduced to permit the spring biased normally closed self-regulating carburetor by-pass valve to admit filtered air at a predetermined reduced vacuum to the engine manifold for continued operation of vacuum accessories and also for reducing the amount of oil drawn past combustion chamber seals and valve guides. Associated with the carburetor by-pass valve is a carburetor vent valve which is simultaneously opened to admit filtered air to the fuel/air passage between the throttle valve and the by-pass control butterfly to thereby eliminate all vacuum that will draw fuel from the carburetor. As a further feature, the electronic controlling circuitry operates to close the by-pass control butterfly for about one-half second upon the opening of the ignition switch to thereby eliminate self-ignition or dieseling and reduced hydrocarbon emissions.

13 Claims, 2 Drawing Figures

CARBURETOR BY-PASS AND FUEL CONTROL SYSTEM

BRIEF SUMMARY OF THE INVENTION

This invention relates to internal combustion engine carburetors and more particularly to an electronically controlled carburetor that stops all fuel flow to the engine during periods when combustion is not required.

Internal combustion engines, such as conventional automotive gasoline fueled engines, draw fuel from the carburetor during periods when it is not required, such as during deceleration of the vehicle or shutdown of the engine, and thus both unnecessarily waste the fuel and also exhausts unburned hydrocarbons to the atmosphere. A solution for eliminating this fuel waste is to by-pass the carburetor or otherwise shut off fuel flow, and to admit only air to the intake manifold during such deceleration periods. This may be accomplished under the control of linkage that is actuated by the release of the engine throttle and admits air at atmospheric pressure to the manifold to thereby eliminate the fuel drawing vacuum produced in the manifold while yet providing the necessary air flow to the engine cylinders. In such a by-pass system, it is clearly necessary that the fuel flow be restored before the engine stops its rotation in order to assure its re-starting.

Many attempts have been made to develop a by-pass type of carburetor that would release the vacuum in the engine intake manifold and/or stop fuel flow during deceleration and yet restore the fuel flow before the engine is finally stalled. For example, U.S. Pat. No. 3,371,914 to B. Walker describes a fuel feed system that employs the differential pressure between the intake manifold and atmospheric to open a carburetor by-pass butterfly while simultaneously closing a valve in the fuel/air passageway between the by-pass entrance port and the throttle valve. Other similar types of fuel-saving carburetors have employed various types of control systems, for example, by sensing of engine speed by mechanical or electrical means or by measuring the voltage output of the engine generator.

These prior art carburetors employ control systems that become activated while the engine is operating while the associated vehicle may be at rest or is being operated at a very low speed such as during parking or in stop-and-go traffic conditions. If the by-pass controls in these prior art carburetors are actuated while the associated vehicle has insufficient velocity to keep the engine turning without the aid of fuel combustion, the engine will stall. Such undesirable activation of the by-pass controls while the vehicle is at rest or at slow speed is very prominent in vehicles equipped with fluid-coupled transmission where slippage in the fluid coupling or torque converter will permit engine speeds above the activating speed of the by-pass control mechanism. It is, therefore, necessary that means be provided for eliminating the possibility of activation of the by-pass control system below a vehicle velocity at which the engine may be re-started upon restoration of the fuel flow and irrespective of the engine speed.

Many other problems are encountered by the prior art carburetors. For example, carburetor by-pass systems employing vacuum operated by-pass valves often malfunction at different atmospheric pressures such as produced by changing elevations encountered in mountain travel. Other fuel shutoff systems which include carburetor by-pass arrangements will often not become activated when the carburetor throttle is in a fast idle position such as required during operation of the choke during the starting of cold engines.

My improved by-pass and control system eliminates the problems encountered in the prior art devices and is activated by throttle release to any throttle crank stop position but only at times when the vehicle velocity is higher than the predetermined minimum velocity necessary to assure a smooth re-start of the engine upon re-application of the throttle and the resulting restoration of fuel flow. Thus, accidental and possibly dangerous stalling cannot occur at slow traffic speeds or during periods that the vehicle may be temporarily stopped during parking or at traffic signals. Furthermore, actuation of my by-pass system, while applying atmospheric air pressure to the carburetor for stopping fuel withdrawal therefrom, provides an air flow to the intake manifold at a reduced predetermined intake manifold vacuum that is sufficient for maintaining power to vehicle vacuum accessories, such as vacuum assisted power brakes. An additional feature provides for activation of the carburetor by-pass at the moment the engine ignition is turned off, and for approximately a half-second thereafter, to cut off fuel and provide unfueled air to the intake manifold. This momentary activation at engine shutoff is effective in eliminating overrun or dieseling caused by fuel detonation or self-ignition, and provides a slight fuel saving and a reduction in engine emissions.

Briefly described, the carburetor by-pass and control system includes a by-pass chamber in the fuel/air passage between a conventional carburetor having a throttle butterfly valve and the engine intake manifold. The by-pass chamber contains a solenoid or motor-operated by-pass control butterfly valve in the fuel/air passage for stopping the flow from the carburetor into the intake manifold. This by-pass control butterfly is located between air passages that interconnect the fuel/air passage with a by-pass/vent valve assembly containing valves that are normally closed to prevent external air at atmospheric pressure from entering the by-pass chamber.

The electronic control circuitry of the system responds to input signals from a vehicle velocity sensor, a switch that closes upon release of the throttle, and the engine ignition switch, and actuates the by-pass control butterfly valve actuating motor or solenoid to stop fuel flow when there is a throttle release above a predetermined minimum vehicle speed necessary to provide a smooth re-start of the engine when fuel is re-applied either via the application of the throttle or a low speed signal to the control circuitry. An additional feature is that the circuitry provides a momentary activation of the by-pass solenoid at the instant the ignition is switched off to thereby eliminate the possibility of engine dieseling and the attendant hydrocarbon emissions.

When the by-pass solenoid is activated by the electronic circuitry to close the by-pass control butterfly valve, the resulting decreased vacuum above the valve releases its vacuum closing bias on by-pass valve in the by-pass/vent valve assembly thus permitting the by-pass valve, also spring biased, to be opened by only an amount necessary to admit outside air to the manifold while maintaining a predetermined intake manifold vacuum necessary for operation of accessory vacuum equipment in the associated vehicle. As the by-pass valve is thus opened, a chamber vent valve, coupled to the by-pass valve, is similarly open to admit outside air at atmospheric pressure into that portion of the by-pass chamber between the by-pass butterfly and the throttle butterfly to thereby remove all vacuum from the carburetor and stop all withdrawal of fuel therefrom.

Accordingly, it is one object of my invention to provide an electronic control system for preventing activation of a fuel shutoff and carburetor by-pass system while a vehicle has insufficient velocity to maintain engine rotation without the aid of fuel combustion.

It is a further object of the invention to provide means for preventing the drawing of fuel/air mixture into the engine after the ignition has been turned off to thereby reduce emissions of unburned hydrocarbons and for preventing dieseling, common with the use of unleaded or low octane fuels.

It is another important object of the invention to provide a vacuum regulating carburetor by-pass and fuel shutoff system which is insensitive to variations in atmospheric pressure changes from sub-sea level to high elevations.

It is still another object of my invention to provide a system which eliminates the need for operating linkage connected to the by-pass valve, thereby permitting maximum freedom of design in the placement of components in the restricted space found in modern engine compartments.

It is a further but important object of the invention to provide a fuel shutoff system that prevents fuel/air mixture from being drawn into the engine during deceleration of the vehicle.

DESCRIPTION OF THE DRAWINGS

In the drawings which illustrate a preferred embodiment of the invention.

DETAILED DESCRIPTION

Figure 1:
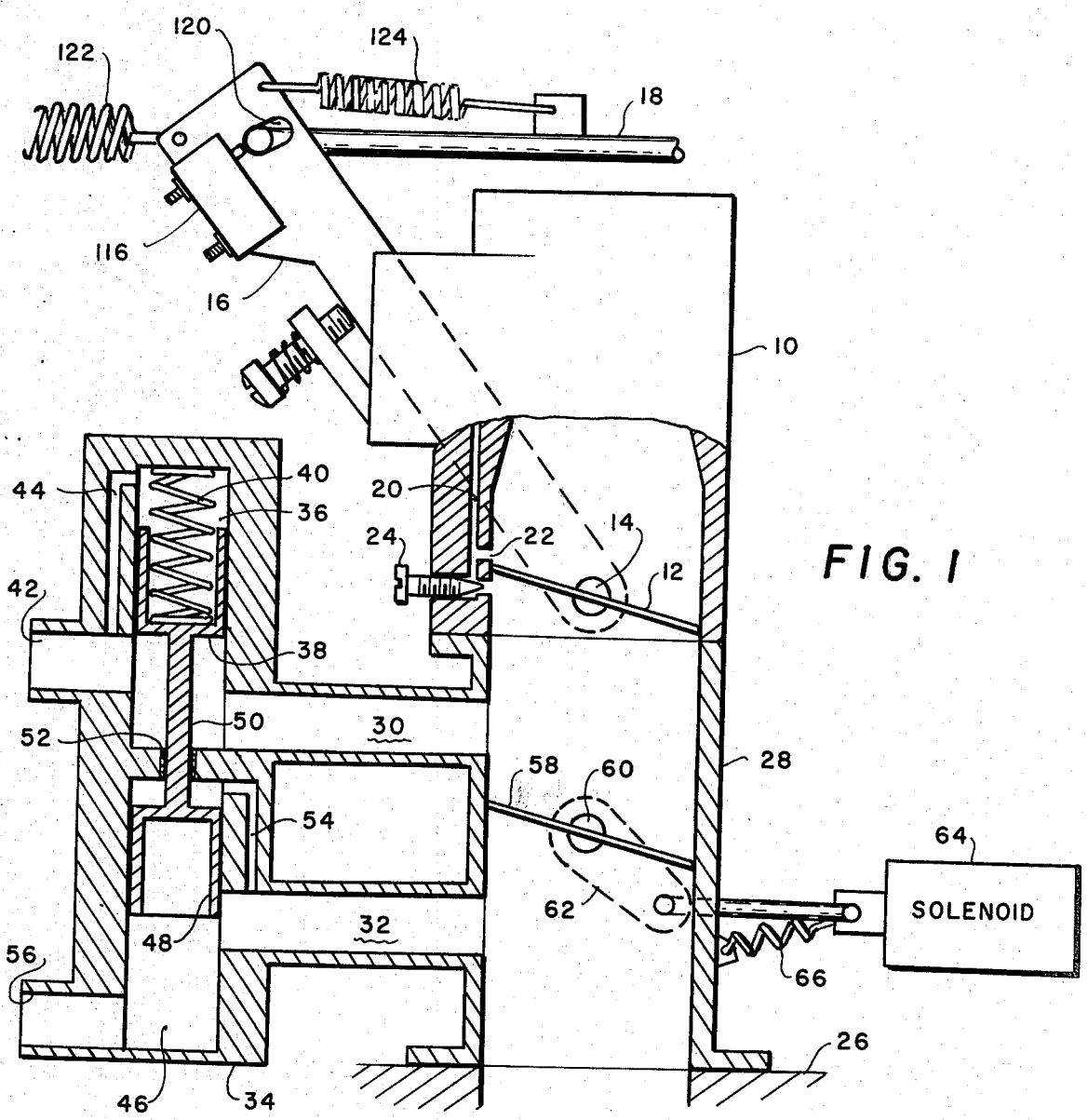
FIG. 1 is a sectional elevation view schematically illustrating the mechanical structure of the carburetor by-pass and control system.

Illustrated in FIG. 1 is a portion of a conventional carburetor 10 having a fuel/air barrel containing a throttle butterfly valve 12 mounted for rotation about an axle 14 that is coupled externally of the carburetor 10 to a throttle crank 16 and a throttle linkage rod 18. The housing of the carburetor 10 contains a conventional low speed fuel passage 20 and fuel port 22 which admits fuel into the barrel upstream of the closed position of the butterfly valve 12. Also coupled to the fuel passage 20 is an idle mixture control screw 24 and its associated port that admits fuel into the barrel 10 downstream of the closed throttle butterfly valve 12.

Interconnected between the carburetor barrel and the entrance port of an engine intake manifold 26 is a carburetor by-pass chamber 28 having a radially aligned vent passage 30 and by-pass passage 32 interconnecting the interior of the chamber 28 with a by-pass/vent valve assembly 34. The valve assembly 34 contains two separate valves which may be diaphragm or sliding piston valves as described. The uppermost cylinder 36 contains a vent valve 38 that is biased downward by a spring 40 toward a direction that tends to block the vent passage 30. A vent port 42 radially enters the bore of the cylinder 36 at a point above the entrance of the vent passage 30 but in a position where the vent port 42 becomes completely blocked by the piston valve 38 when in its normal location as biased by the spring 40. Connected between the closed head of the cylinder 36 and the vent port 42 is a small vent passage 44.

The by-pass passage 32 interconnects the bore of by-pass chamber 28 with a by-pass cylinder 46 in the valve assembly 34. Slidable within cylinder 36 is a by-pass valve 48 which is directly connected to the vent valve 38 by way of a piston rod 50 that readily slides through a seal 52 in the partition separating the cylinders 36 and 46. The length of the connecting rod 50 is such that when the vent valve 38 is biased downward by spring 40 to close the vent port 42, the by-pass valve 48 will have closed the by-pass passage 32 from the cylinder 46. Further, upon opening as illustrated in the figure, the vent port 42 must be opened by valve 38 either simultaneously with or prior to the opening of the by-pass passage 32 by valve 48. A vent passage 54 in the housing of the valve assembly 34 interconnects the by-pass passage 32 with the head of the cylinder 46 adjacent the connecting rod 50 and seal 52. A by-pass port 56 radially interconnects the bore of the cylinder 46 at the end opposite the vent passage 54, to an outside air source.

Interposed in the by-pass chamber 28 between the radial vent passage 30 and the by-pass passage 32 is a by-pass control butterfly valve 58 that is mounted for rotation on an axle 60 which is connected externally of the housing of the by-pass chamber 28 to a crank 62 operated by a solenoid 64. By-pass butterfly 58 is, during normal operation of the engine, fully opened and maintained in this position by a return spring 66. As will be subsequently explained, activation of the solenoid 64 by the associated electronic control circuitry of FIG. 2 will fully close the butterfly valve 58 to the position indicated in FIG. 1 of the drawings.

Figure 2:
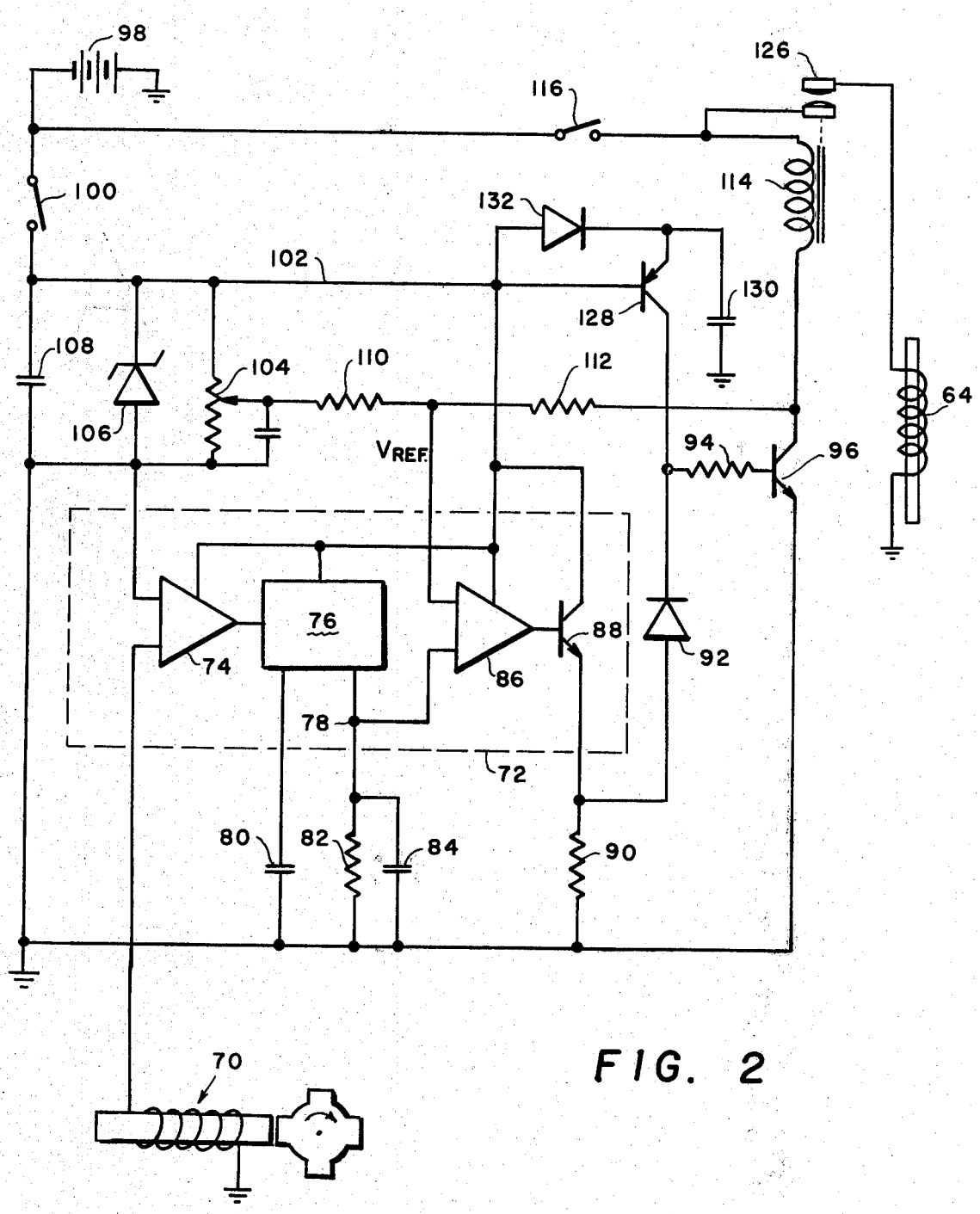
FIG. 2 is an electrical schematic diagram of control circuitry for activating the by-pass system of FIG. 1.

FIG. 2 is an electric schematic diagram of the control circuitry for actuation of the solenoid 64 of FIG. 1. An electrical tachometer or magnetic pickup 70 which may be connected to the vehicle drive shaft or speedometer cable to sense vehicle velocity is connected to a frequency-to-D.C. voltage converter 72 which may, for example, be a type LM-2907-8 integrated circuit manufactured by National Semiconductor Corporation. The converter 72 includes an input differential amplifier 74, the inverting input of which may be connected to ground reference, followed by a charge pump 76 which receives the output of amplifier 74 and converts the amplified A.C. to a corresponding D.C. voltage signal at terminal 78. A suitable timing capacitor 80 is connected between the charge pump 76 and ground and a resistor 82 and filter capacitor 84, in parallel, are coupled between the D.C. output terminal 78 and ground reference.

The D.C. output of the charge pump 76 is applied to the non-inverting input terminal of a differential amplifier 86, the inverting input terminal of which is connected to a voltage reference to be subsequently explained. The output of the differential amplifier is then amplified by an NPN transistor 88, the emitter of which is connected to ground through a resistance 90 and to the anode of a diode 92, the cathode of which is coupled through a resistance 94 to the base of NPN power transistor 96.

D.C. power from the vehicle battery 98 is applied through the vehicle ignition switch 100 to a conductor 102 to which is connected the various electrical components such as the frequency-to-D.C. converter 72. A variable potentiometer 104 is coupled between the conductor 102 and ground and is by-passed by a Zener diode 106 which provides protection against high voltage inductive spikes, and also by-passed by a filter capacitor 108.

The potentiometer 104 provides a variable vehicle speed threshold adjustment for the control circuitry. The wiper arm of the potentiometer 104 is connected through a voltage divider comprising resistors 110 and 112 in series to the collector of the power transistor 96. The collector of transistor 96 is also coupled through a relay coil 114 in series with a switch 116 to the positive terminal of the vehicle battery 98. The switch 116 is normally open and is illustrated in FIG. 1 as a miniature switch mounted to the throttle crank 16. Throttle linkage rod 18 in FIG. 1 is connected to the throttle crank 16 through an elongated slot 120. The throttle crank 16 is urged into a throttle-closed position by a spring 122 and the throttle linkage rod 18, when released, is urged by the spring 124 against the actuating pin of the switch 116 to thereby close the switch 116.

Returning now to FIG. 2, the switch 116, when closed by release of the engine throttle, will complete the circuit between the vehicle battery 98 and through the relay coil 114 to the collector of the power transistor 96 which operates as a series switch for actuating the relay contacts 126 and also as a switch which will vary the potential across the voltage divider comprising the resistors 110 and 112. Thus, when the power transistor 96 is conductive, its collector is substantially at ground thus providing hysteresis between the switching point and the reset point of the differential amplifier 86.

To render the power transistor 96 conductive, the D.C. output at terminal 78 of the converter 72 must exceed the voltage reference between resistors 110 and 112. This occurs, of course, only when the vehicle has a sufficient velocity so that the electronic tachometer 70 will generate a suitable frequency which, when converted, will result in a voltage that is higher than the reference voltage that is produced by adjustment of the potentiometer 104. If the power transistor 96 is thus rendered conductive, any release of the vehicle's throttle will close switch 116 to complete a circuit and apply an actuating current through the relay coil 114 to thereby close the contacts 126. If the solenoid 64 may be controlled by the current through the power transistor 96, it may replace the relay illustrated by the coil 114 and contacts 126. If, on the other hand, the solenoid requires more current than can be safely conducted through the transistor 96, then the relay should be used to conduct vehicle power through the relay contacts 126 and to the coil in the solenoid 64.

If the vehicle is traveling at a velocity less than that predetermined by the adjustment of the potentiometer 104 in the circuitry of FIG. 2, the D.C. output at terminal 78 of the converter 72 will be insufficient to override the voltage reference and the differential amplifier will not turn on transistor 88 or the power transistor 96. This occurs during slow traffic speed, parking of the vehicle, etc., and the accelerator position switch 116 may be closed as often as desired without actuation of the by-pass solenoid 64.

The circuitry of FIG. 2 further includes a PNP transistor 128, the base of which is connected to the ignition switch conductor 102, the collector of which is connected to the input resistor 94 to the power transistor 96 and the emitter of which is connected to a relatively large storage capacitor 130, the opposite terminal of which is grounded. During the time that the ignition switch 100 is closed and the engine is in operation, the capacitor 130 is charged through a diode 132 connected between the switched conductor 102 and the capacitor 130. Thereafter whenever the ignition switch 100 is opened to stop the engine, the capacitor 130 will discharge through transistor 128 and into the base of the power transistor 96 to thereby turn it on for a short period of approximately one-half second or until the capacitor 130 has been sufficiently discharged. As previously discussed, this momentary activation of the by-pass solenoid 64 will cut off fuel flow to the engine and will thereby eliminate the possibility of engin dieseling. For maximum control of emissions of unburned hydrocarbons, it is necessary to select a value for capacitor 130 that will actuate power transistor 96 for approximately 0.3 seconds after opening the ignition switch 100.

OPERATION

In operation, the engine is started after closing the ignition switch 100 to thereby apply voltage to the switched conductor 120 of FIG. 2 and to the various circuits. When the throttle is open, switch 116 is returned to its normally open position and when the vehicle is accelerated, an A.C. output is generated by the magnetic pickup or tachometer 70. At a desired vehicle velocity, as determined by the setting of potentiometer 104, the D.C. output of terminal 78 of the converter 72 would be sufficient to overcome the voltage reference between the resistors 110 and 112 and the output current of transistor 88 will generate a voltage across the resistor 90 that is sufficient to render the power transistor switch 96 to its ON condition.

Whenever force is removed from the throttle linkage 18 to cause the vehicle to decelerate, the spring 124 of FIG. 1 will cause the end of the throttle linkage rod 18 to slide in the elongated slot 120 to close the switch 116. The circuit is thereby completed between the vehicle battery 98 and through relay coil 114 to close the contacts 126 and to activate the solenoid 64.

During normal engine operation the by-pass control butterfly 58 is open and equal vacuums on pistons 38 and 48, together with the bias of spring 40, lock the valves 36 and 46 in a closed position. Activation of solenoid 64 of FIG. 1 will cause the by-pass control butterfly 58 to close in the by-pass chamber 28. This closure forms a chamber between the carburetor by-pass control butterfly 58 and the throttle butterfly valve 12. This chamber, being no longer connected with the intake manifold, rapidly loses its vacuum and approaches an atmosphere pressure. This atmospheric pressure, conducted through the passage 30 to the head of valve 38, thereby enables or unlocks the closed valve by removing that part of the closing bias previously attributable to vacuum. The portion of the by-pass chamber downstream of the by-pass control butterfly 58 together with the by-pass passage 32 and vent passage 54, remain at the vacuum of the intake manifold to thereby draw open the by-pass valve 48 against the bias of the spring 40 in the cylinder 36. When valve 48 is drawn upward, the vent valve 38 is similarly drawn upward to open the vent port 42 to the vent passage 30. Vent port 42 is connected to a source of filtered air at atmospheric pressure and this admission of air into the barrel of the by-pass chamber upstream of the by-pass control butterfly 58 removes all vacuum remaining in the carburetor 10 to thereby stop all fuel flow.

Intake manifold vacuum applied to the by-pass passage 32 and admitted to the vent passage 54 will draw up the by-pass valve 48 to a point where the vacuum in passage 32 and intake manifold 26 is balanced by the biasing of the spring 40. In the preferred embodiment, spring 40 is selected to permit the by-pass valve 48 to open only that amount necessary to maintain an intake manifold vacuum of approximately ten inches of mercury. This permits the continued use of vacuum-operated vehicle accessories, such as power brakes, and has additional benefits of preventing oil from being drawn around combustion chamber seals, such as piston rings and valve guides, and also reduces leakage of air around the by-pass control butterfly 58.

The by-pass port 56 is preferably connected to a filtered source of air at atmospheric pressure and may, if desired, be interconnected with the vent port 42 at the vehicle air intake chamber. Separation of the vent port 42 and by-pass port 56 is necessary to prevent high velocity air in the by-pass port 56 to cause a pressure drop through the vent port 42 and in the chamber between the by-pass butterfly 58 and the throttle butterfly 12. It is, therefore, preferable that the vent port 42 and the by-pass port 56 be separately connected by a suitable tubing to the vehicle's filtered air intake chamber.

When the by-pass control butterfly 58 is thus closed, no fuel is admitted into the intake manifold of the engine; hence there is a considerable fuel savings in addition to a material reduction in hydrocarbon emissions from the engine. When the throttle is activated, the linkage rod 18 of FIG. 1 is moved to the right to open switch 116 and the solenoid 64 returns the by-pass control butterfly 58 to its full open position. The butterfly 58 is also returned to its full open position, without throttle application, when the vehicle speed is insufficient for the tachometer 70 of FIG. 2 to generate a signal that exceeds the reference voltage selected by potentiometer 104. All air pressures acting on the carburetor by-pass/vent valve 34 then become equalized and spring 40 operates rapidly to bias the vent valve 38 and by-pass valve 48 downward to block the by-pass passage 38 and the vent port 42. The vacuum of the engine intake manifold is then applied through the by-pass chamber and into the carburetor 10 to draw a fuel/air mixture into the engine.

Having thus described my invention, what is claimed is:

1. A control system for a motor vehicle internal combustion engine fuel dispensing system having a throttle valve and fuel shutoff means including a second valve for shutting off fuel flow between the throttle valve and the engine, said control system including:

first signal means coupled to the throttle valve of said fuel dispensing system for outputting a first signal upon closure of said throttle valve;

second signal means coupled to a rotatable member of the motor vehicle for generating a second signal proportional to the velocity of said vehicle;

velocity threshold adjusting means coupled to the D.C. power source of said vehicle for producing a third signal at a predetermined D.C. level;

circuitry receiving each of said first, second and third signals for generating in response thereto an output signal when said second signal exceeds the threshold of said third signal during existence of said first signal; and actuating means coupled to the second valve in the fuel dispensing system and responsive to the output signal of said circuitry for closing said valve upon occurrence of said output signal.

2. The system claimed in claim 1 wherein said first signal is derived from a switch actuated by the motion of throttle linkage in a direction that closes said throttle valve, the actuation of said switch being independent of idle speed adjustment of said fuel dispensing system.

3. The system claimed in claim 1 wherein said second signal is derived from electrical tachometer means for generating an electrical signal proportional to the velocity of said vehicle.

4. The system claimed in claim 1 wherein said circuitry further includes actuating circuitry responsive to an opening of the engine ignition switch for momentarily activating said actuating means upon engine shutdown, whereby fuel to said engine is shut off at said fuel dispensing system for eliminating engine dieseling and emissions of unburned fuels.

5. An internal combustion engine carburetor by-pass and control system comprising:

a by-pass chamber having a barrel interposed between and interconnecting the engine carburetor and the intake manifold of said engine;

first and second spaced passages intercoupling said barrel with first and second ports, respectively, said ports being connected to a source of air at a substantially atmospheric pressure;

an electrically controlled by-pass valve within the barrel of said chamber and positioned, when closed, to substantially block flow through said barrel at a point between said first and second spaced passages;

valving means interposed between said first and second spaced passages and said first and second ports, said valving means including biasing means for maintaining a normally closed interrupted communication between said first port and said first passage, and between said second port and said second passage, said valving means being opened by intake manifold vacuum by only an amount necessary to maintain a predetermined vacuum in said intake manifold.

6. The system claimed in claim 5 wherein said valving means includes first and second valves interconnected for simultaneous operation, at least one of said first and second valves being vacuum and spring biased for interrupting the communications between said first and second ports and said first and second passages, said first passage being in open communication with said intake manifold and having a vent passage for applying manifold vacuum to said first valve for urging said first valve to open against the force of said spring bias wherein a reduced vacuum, determined by said spring bias, is maintained in said intake manifold.

7. The system claimed in claim 6 wherein said first and second valves are first and second pistons movable within separated first and second cylinders, respectively, said first and second pistons being interconnected by linkage for simultaneous operation.

8. The system claimed in claim 7 wherein said second piston is first to open a communication between said second port and said second passage upon the initiation of the opening of said first valve by manifold vacuum over the predetermined force of said spring bias, whereby air at substantially atmospheric pressure is applied to said by-pass chamber upstream of said by-pass valve for eliminating fuel-drawing vacuum from said engine carburetor.

9. The system claimed in claim 5 wherein said electrically controlled by-pass valve is closed in said chamber by a solenoid that is operated by circuit means responsive to a first signal indicating a closed throttle valve in said engine carburetor and a second signal proportional to the velocity of the vehicle driven by the internal combustion engine, said circuit means actuating said solenoid to close said by-pass valve upon the occurrence of said first signal and said second signal at a level above a predetermined adjustable minimum value.

10. The system claimed in claim 9 wherein said first signal is derived from a switch actuated by the position of engine carburetor throttle linkage.

11. The system claimed in claim 9 wherein said second signal is derived from electrical tachometer means for generating an electrical signal proportional to the velocity of said vehicle.

12. The system claimed in claim 9 wherein said circuit means further includes additional actuating circuitry responsive to an opening of the engine ignition switch for momentarily actuating said solenoid upon engine shutdown, whereby fuel to said engine is shut off at said carburetor for eliminating engine dieseling and the emission of unburned fuel from the engine exhaust.

13. A control system for a motor vehicle internal combustion engine fuel dispensing system having a throttle valve and fuel shutoff means including a second valve for shutting off fuel flow between the throttle valve and the engine, said control system comprising:

first signal producing means coupled to the throttle valve of said fuel dispensing system for outputting a first signal upon closure of said throttle valve;

second signal producing means coupled to a rotatable velocity responsive member of the motor vehicle, other than the engine, for generating a second signal proportional to the velocity of said vehicle;

signal conditioning means including hysteresis circuitry responsive to said second signal for generating an output signal above a predetermined velocity of said vehicle; and actuating means coupled to said first signal producing means and to said signal conditioning means and responsive to each of said first and said output signals for closing said second valve in said fuel dispensing system upon the combined occurrence of said first signal and said output signal.

* * * * *